US005261131A

United States Patent [19]

Kilby

[11] Patent Number: 5,261,131

[45] Date of Patent: Nov. 16, 1993

[54] BEACH BLANKET ASSEMBLY

[76] Inventor: Kevin B. Kilby, 115 Spring Lake Way, Havre de Grace, Md. 21078

[21] Appl. No.: 993,363

[22] Filed: Dec. 18, 1992

[51] Int. Cl.[5] ..... A47G 9/06

[52] U.S. Cl. ..... 5/419; 5/417; 5/922

[58] Field of Search ..... 5/417–420, 5/922, 436, 644

[56] References Cited

U.S. PATENT DOCUMENTS 4,223,056 9/1980 Di Fonzo ..... 5/417
4,654,906 4/1987 Roberts ..... 5/417
4,703,528 11/1987 Rolle ..... 5/417
4,709,430 12/1987 Nicoll ..... 5/417
5,018,229 5/1991 Eberhart ..... 5/417
5,072,467 12/1991 Hunt ..... 5/417

*Primary Examiner*—Alexander Grosz
*Attorney, Agent, or Firm*—Leon Gilden

[57] ABSTRACT

A beach blanket includes a central fabric web, having a plurality of perimeter flap members defining individual pockets thereabout, with the flap members arranged to accommodate various portions of a granular material therewithin for securement of a beach blanket relative to an underlying beach surface.

4 Claims, 4 Drawing Sheets

BEACH BLANKET ASSEMBLY

BACKGROUND OF THE INVENTION

1. Field of the Invention

The field of invention relates to beach blanket structure, and more particularly pertains to a new and improved beach blanket assembly wherein the same is arranged to receive granular material for anchoring of a beach blanket structure in use.

2. Description of the Prior Art

Beach blanket structure of various types have been utilized throughout the prior art as exemplified in the U.S. Pat. Nos. 4,654,906; 5,018,229; and 4,709,430.

The instant invention attempts to overcome deficiencies of the prior art by providing for a beach blanket structure having a plurality of pockets, as well as an associated pillow structure mounted thereon and in this respect, the present invention substantially fulfills this need.

SUMMARY OF THE INVENTION

In view of the foregoing disadvantages inherent in the known types of beach blanket structure now present in the prior art, the present invention provides a beach blanket assembly wherein the same is arranged to include spaced pockets about a perimeter of a central beach blanket. As such, the general purpose of the present invention, which will be described subsequently in greater detail, is to provide a new and improved beach blanket assembly which has all the advantages of the prior art beach blanket structure and none of the disadvantages.

To attain this, the present invention provides a beach blanket including a central fabric web, having a plurality of perimeter flap members defining individual pockets thereabout, with the flap members arranged to accommodate various portions of a granular material therewithin for securement of a beach blanket relative to an underlying beach surface.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved beach blanket assembly which has all the advantages of the prior art beach blanket structure and none of the disadvantages.

It is another object of the present invention to provide a new and improved beach blanket assembly which may be easily and efficiently manufactured and marketed.

It is a further object of the present invention to provide a new and improved beach blanket assembly which is of a durable and reliable construction.

An even further object of the present invention is to provide a new and improved beach blanket assembly which is susceptible of a low cost of manufacture with regard to both materials and labor, and which accordingly is then susceptible of low prices of sale to the consuming public, thereby making such beach blanket assemblies economically available to the buying public.

Still yet another object of the present invention is to provide a new and improved beach blanket assembly which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
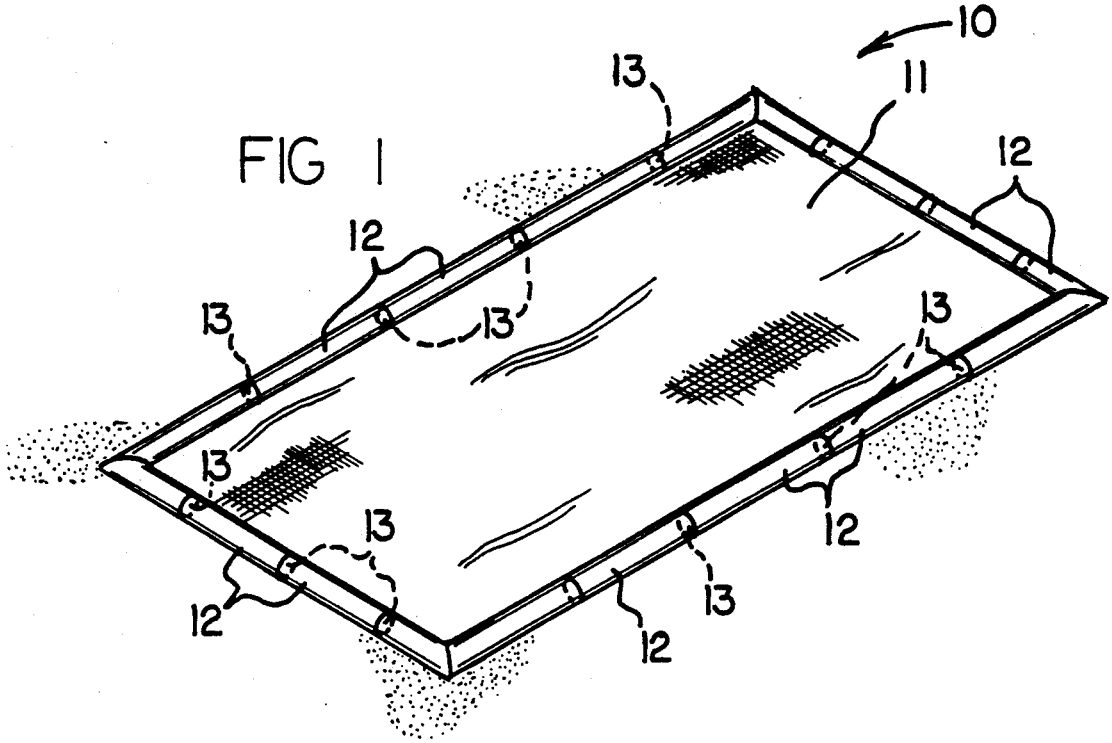
FIG. 1 is an isometric illustration of the invention.
Figure 2:
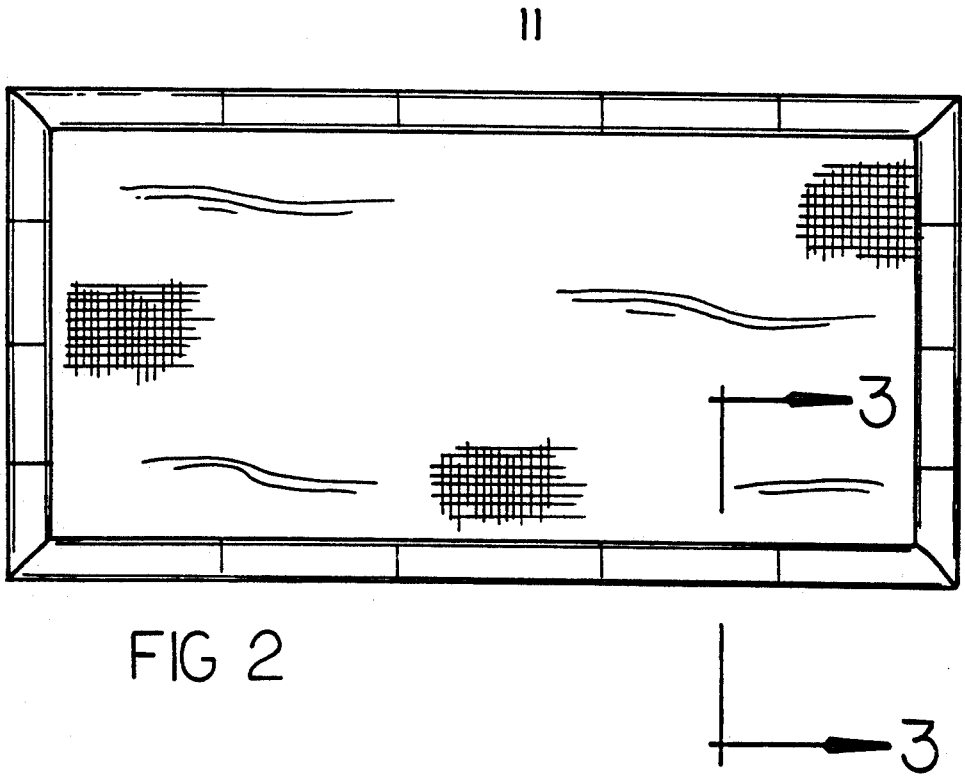
FIG. 2 is an orthographic top view of the invention.

With reference now to the drawings, and in particular to FIGS. 1 to 9 thereof, a new and improved beach blanket assembly embodying the principles and concepts of the present invention and generally designated by the reference numeral 10 will be described.

Figure 3:
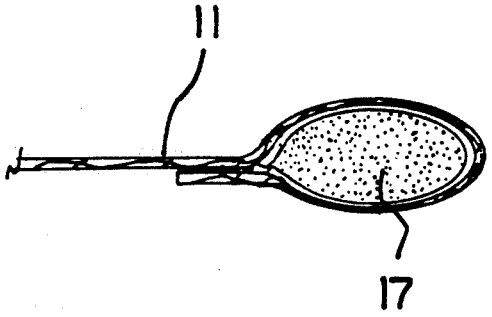
FIG. 3 is an orthographic view, taken along the lines 3—3 of FIG. 2 in the direction indicated by the arrows.
Figure 4:
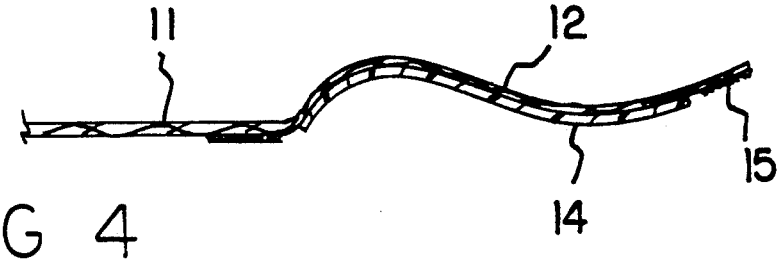
FIG. 4 is an orthographic side view of the pocket structure in an opened and disengaged configuration relative to the central web.
Figure 5:
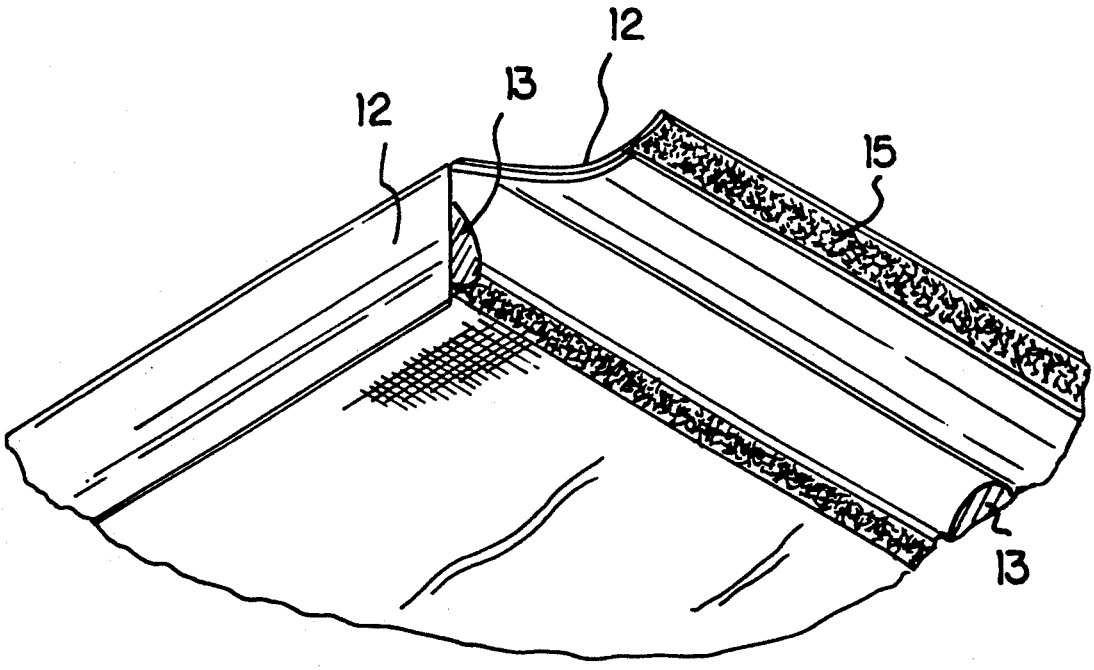
FIG. 5 is an isometric bottom view of a pocket structure.

More specifically, the beach blanket assembly 10 of the instant invention essentially comprises a central fabric web 11, typically formed of fluid absorbent material, having a plurality of perimeter flap members 12 extending coextensively about the web 11. Partition walls 13 are oriented between adjacent flap members 12, as indicated, and the partition walls oriented generally perpendicular to the web top surface, to demarcate individual pockets defined by the individual flap members 12 relative to and between individual spaced adjacent partition walls 13. Each flap member 12 includes a polymeric fluid impermeable liner 14, of a type as indicated in FIG. 4 for example, with a first hook and loop fastener strip 15 mounted to a free distal end of each flap member 12 cooperative with a second hook and loop fastener strip 16 mounted to a bottom surface of the central web 11. In this manner, a granular medium 17 such as sand may be positioned within each pocket and secured therewithin, in a manner as indicated in FIG. 3, having the first and second hook and loop fastener strips 15 and 16 arranged for securement relative to one another.

Figure 6:
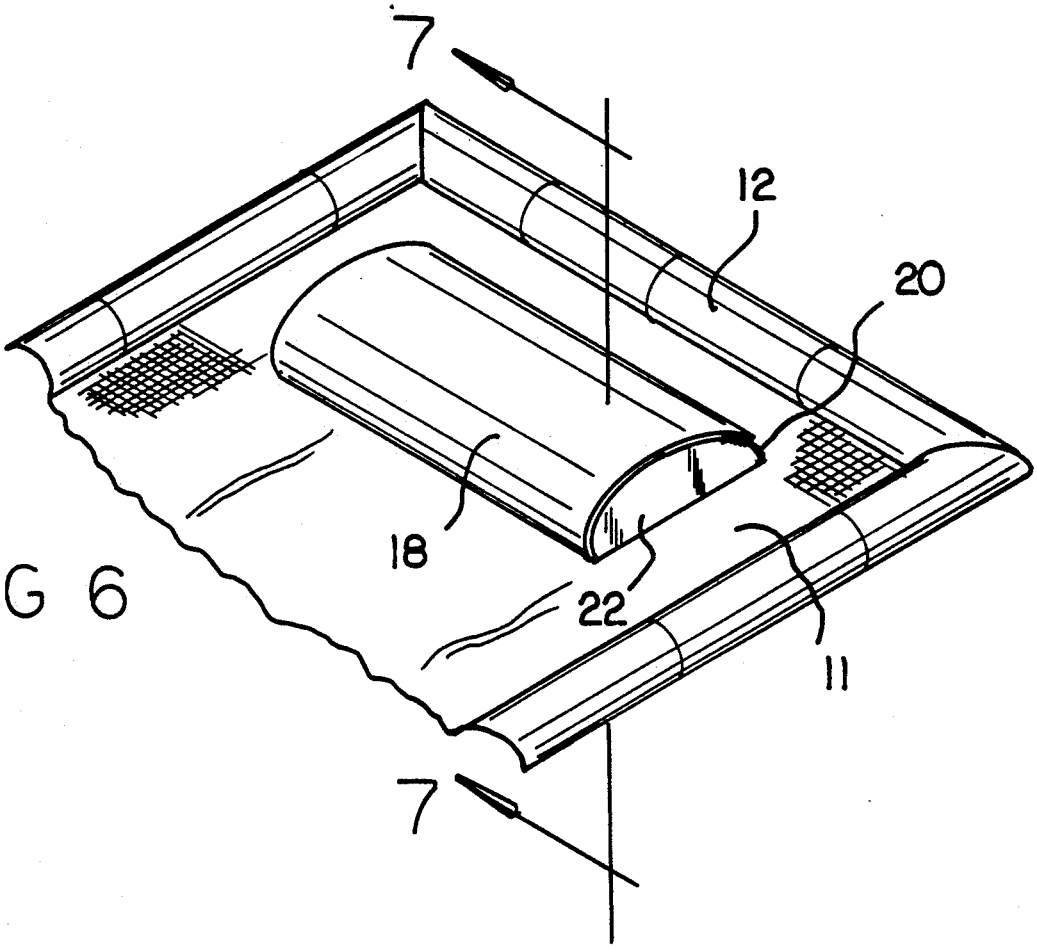
FIG. 6 is an isometric illustration of the pillow structure employed by the invention.
Figure 7:
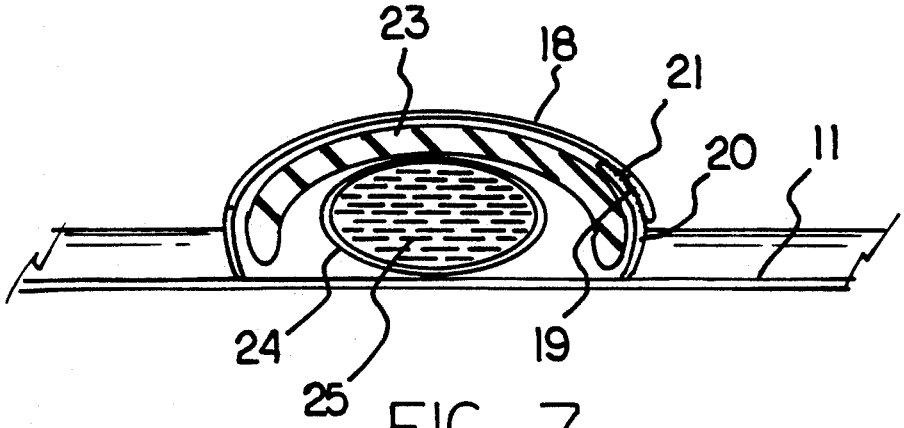
FIG. 7 is an orthographic view, taken along the lines 7—7 of FIG. 6 in the direction indicated by the arrows.

A first pillow flap 18 is provided, such as indicated in FIG. 6, mounted to a top surface of the central web 11, with the first pillow flap 18 having a third hook and loop fastener strip 19 mounted to a free end of the first pillow flap 18. A second pillow flap 20 mounted to the top surface of the central web 11 coextensive with the first pillow flap in a spaced parallel relationship includes a fourth hook and loop fastener strip 21 at a free edge of the second pillow flap 20, with the third and fourth hook and loop fastener strips 19 and 21 arranged for securement relative to one another, in a manner as indicated in FIGS. 6 and 7, between spaced pillow end walls 22. Between the pillow end walls 22 is positioned a semi-cylindrical cushion insert 23 coextensive with the first and second pillow flaps 18 and 20 and spaced above the top surface of the central web 11. A refrigerant gel 25 is provided with the gel 25 positioned within a flexible housing insert 24 coextensive with the cushion insert 23 and between the end walls 22.

Figure 8:
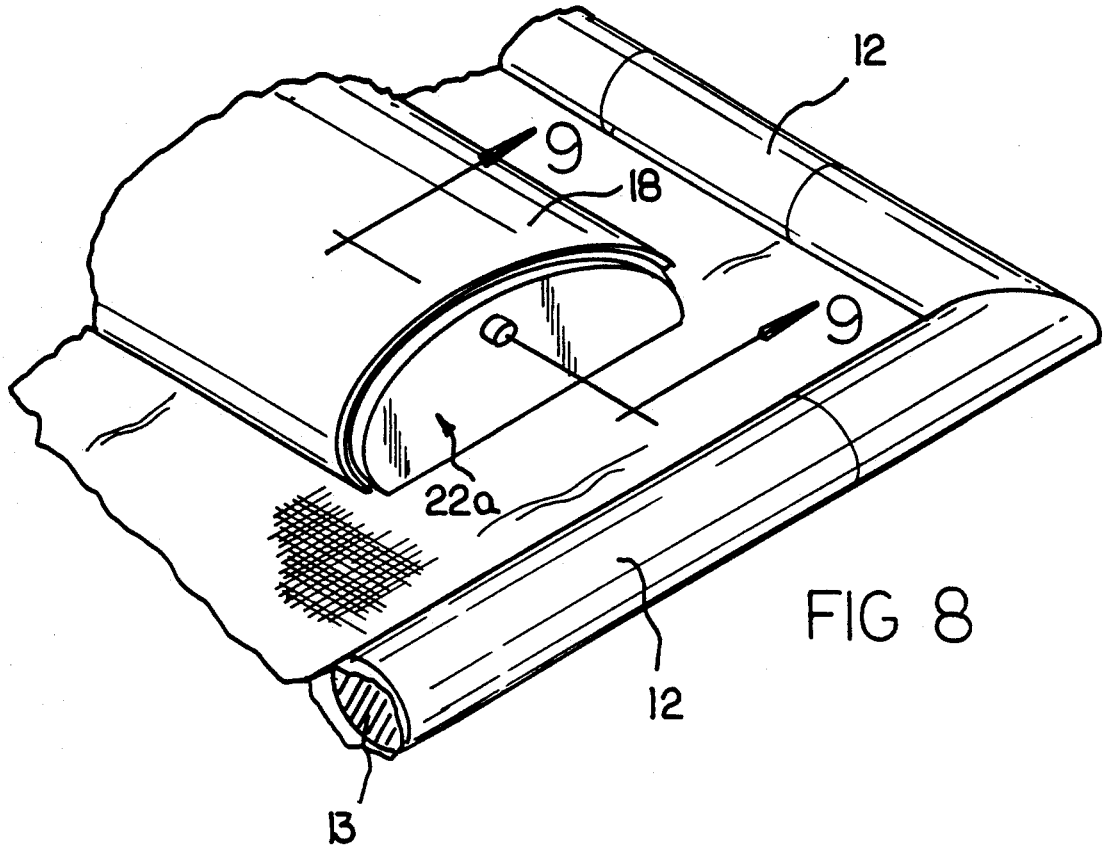
FIG. 8 is an isometric illustration of a modified pillow structure as employed by the invention.
Figure 9:
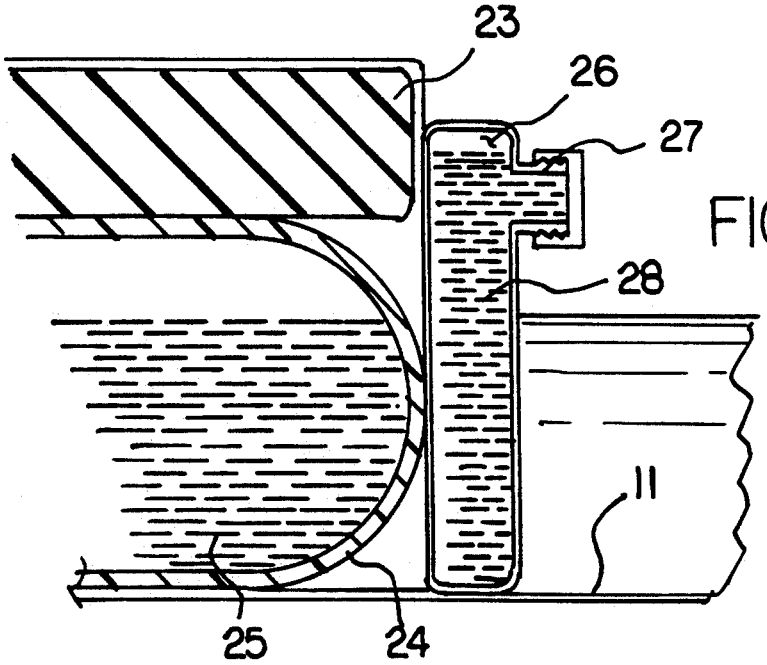
FIG. 9 is an orthographic view, taken along the lines 9—9 of FIG. 8 in the direction indicated by the arrows.

The FIGS. 8 and 9 indicate a modified end wall structure **22*a*, such as at least one of the end walls includes a flexible housing, such as indicated in FIG. 9, having a fluid chamber 26 therewithin. The fluid chamber 26 includes a chamber fill port 27 directed through the flexible housing to permit filling and emptying of a skin lotion 28 contained within the fluid chamber 26, wherein access to the filling and removal of such skin lotion 28 is directed through the fill port 27, having a removable cap mounted thereon. Proximity and in contiguous relationship of the flexible housing 22*a* relative to the refrigerant gel 25 enhances cooling of the skin lotion 28** to enhance a soothing effect when applied to an individual's skin in a topical manner.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A beach blanket assembly, comprising, a central fabric web, having a plurality of perimeter flap members, wherein the flap members are arranged coextensively about the web, and each of the flap members are positioned between spaced partition walls mounted to the central web, wherein said each flap member defines a pocket when secured to the central web, and said each flap member includes a polymeric liner substantially coextensive with said each flap member, and said each flap member includes a first hook and loop fastener strip mounted to each flap member free distal end, and a plurality of second hook and loop fastener strips mounted to the central web, wherein each of said second hook and loop fastener strips is mounted in adjacency to one of said first hook and loop fastener strips to permit securement of a granular medium within said pocket, and the web includes a top surface and a bottom surface, wherein the top surface includes a first pillow flap fixedly mounted to the top surface, and a second pillow flap mounted to the top surface in a spaced relationship relative to the first pillow flap, wherein the first pillow flap and the second pillow flap are arranged in a coextensive relationship, and side walls are directed between the first pillow flap and the second flap on opposed sides of the first pillow flap and the second pillow flap directed between the first pillow flap and the second flap, and the first pillow flap includes a third hook and loop fastener strip, and the second pillow flap includes a fourth hook and loop fastener strip, wherein the third hook and loop fastener strip and the fourth hook and loop fastener strip are arranged for securement relative to one another, and the spaced partition walls are mounted generally perpendicular relative to the top surface.

2. A beach blanket assembly as set forth in claim 1 including a semi-cylindrical cushion insert mounted between the side walls and between the first pillow flap, the second pillow flap, and the top surface.

3. A beach blanket assembly as set forth in claim 2 including a flexible housing insert coextensive with the semi-cylindrical cushion insert, wherein the flexible housing insert includes a refrigerant gel contained therewithin permitting cooling of the refrigerant gel.

4. A beach blanket assembly as set forth in claim 3 wherein one of said side walls includes a flexible housing positioned in contiguous communication with the flexible housing insert, wherein the flexible housing includes a fluid chamber contained therewithin, wherein a fill port is directed through the flexible housing having a removable cap, with a skin lotion positioned within the fluid chamber permitting cooling of the skin lotion by permitting cooling of the fluid chamber with the refrigerant gel positioned within the flexible housing insert.

* * * * *